US008348817B2

(12) United States Patent
Bruns et al.

(10) Patent No.: US 8,348,817 B2
(45) Date of Patent: Jan. 8, 2013

(54) INSPECTION MODEL AND FOLDER GLUER HAVING AN INSPECTION MODULE

(75) Inventors: Dirk Bruns, Krefeld (DE); Wolfgang Diehr, Grevenbroich (DE); Uwe Hartstock, Nettetal (DE); Sedat Padar, Köln (DE); Frank Schmid, Krefeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/222,082

(22) Filed: Aug. 31, 2011

(65) Prior Publication Data

US 2012/0053032 A1 Mar. 1, 2012

(30) Foreign Application Priority Data

Aug. 31, 2010 (DE) ..... 10 2010 036 012

(51) Int. Cl.
*B31B 1/00* (2006.01)
*B31B 1/26* (2006.01)

(52) U.S. Cl. ..... 493/11; 493/53; 493/162

(58) Field of Classification Search ..... 493/7, 10, 493/11, 12, 13, 16, 17, 25, 29, 53, 55, 123, 493/162

See application file for complete search history.

(56) References Cited

U.S. PATENT DOCUMENTS 3,473,613 A * 10/1969 Boyce ..... 171/14
3,643,552 A * 2/1972 Stork ..... 493/14
4,319,137 A * 3/1982 Nakamura et al. ..... 250/556
5,034,616 A * 7/1991 Bercovitz ..... 250/556
5,598,006 A * 1/1997 Stringa ..... 250/559.46
5,654,802 A * 8/1997 Kurachi et al. ..... 356/394
5,807,222 A 9/1998 Totani
5,934,186 A * 8/1999 Alberga et al. ..... 99/489
6,490,783 B2 * 12/2002 Karaki et al. ..... 29/714
7,402,129 B2 7/2008 Diehr
7,670,274 B2 3/2010 Diehr et al.
7,678,035 B2 3/2010 Jansen
7,794,379 B2 9/2010 Diehr et al.
7,971,346 B2 * 7/2011 Hosel et al. ..... 29/743

(Continued)

FOREIGN PATENT DOCUMENTS

DE 2658897 A1 6/1978

(Continued)

OTHER PUBLICATIONS

German Patent and Trademark Office Search Repor, Dated Jul. 22, 2010.

*Primary Examiner* — Paul R Durand

(74) *Attorney, Agent, or Firm* — Laurence A. Greenberg; Werner H. Stemer; Ralph E. Locher

(57) ABSTRACT

An inspection module for flat, sheet-shaped material made of paper, board or the like, includes an inspection system disposed below a sheet transport plane. The sheets are transported by contacting upper and lower conveying elements of at least one upper and one lower conveying device, at least one of which is connected to a drive. The lower conveying device is divided and is formed of at least two conveying devices with a gap formed therebetween. The inspection system is disposed in the gap. A folder gluer or folding-box gluer having an inspection module is also provided.

30 Claims, 10 Drawing Sheets

U.S. PATENT DOCUMENTS

| | | | | |
|---|---|---|---|---|
| 2007/0241900 | A1* | 10/2007 | Sasazaki | 340/572.1 |
| 2009/0107896 | A1* | 4/2009 | Gochar, Jr. | 209/577 |
| 2009/0115127 | A1* | 5/2009 | Konig et al. | 271/265.04 |
| 2010/0210436 | A1 | 8/2010 | Taketsugu | |

FOREIGN PATENT DOCUMENTS

| | | | |
|---|---|---|---|
| DE | 196 04 856 | A1 | 8/1997 |
| DE | 198 21 875 | A1 | 11/1999 |
| DE | 10 2004 022 344 | A1 | 12/2005 |
| DE | 10 2005 050 040 | A1 | 8/2006 |
| EP | 0668577 | A1 | 8/1995 |
| EP | 0675466 | A2 | 10/1995 |
| EP | 0701895 | A2 | 3/1996 |
| EP | 2213449 | A1 | 8/2010 |

* cited by examiner

INSPECTION MODEL AND FOLDER GLUER HAVING AN INSPECTION MODULE

CROSS-REFERENCE TO RELATED APPLICATION

This application claims the priority, under 35 U.S.C. §119, of German Patent Application DE 10 2010 036 012.0, filed Aug. 31, 2010; the prior application is herewith incorporated by reference in its entirety.

BACKGROUND OF THE INVENTION

Field of the Invention

The invention relates to an inspection module for inspecting flat, sheet-shaped material made of paper, board or the like, in particular printed or unprinted sheets, folding box blanks or folding boxes. The inspection module includes an inspection system that is formed of a camera, a light source and a housing, which are disposed below a plane of sheet transport. A sheet transport device including at least one upper and one lower conveying device with contacting conveying elements is provided for transporting the sheets. At least one of the upper and/or lower conveying devices is connected to a drive. The invention also relates to a folder gluer or folding-box gluer having an inspection module.

High-quality printed products, such as folding boxes for the pharmaceutical or cosmetic industry, require the highest quality in every respect, from the printed sheets to the cut folding box blanks and finally to the finished, folded and glued folding boxes. Moreover, imprints on folding boxes produced for the pharmaceutical industry must meet strict accuracy requirements. Thus, the folding box production workflow requires frequent checks for errors and defects, such as:

- Paper defects such as board inclusions,
- Foreign particles such as dust, undesired foil residue, cutting waste, adhesive labels and glue residue,
- Color deviations or varnish defects (missing varnish, varnish on surfaces where it ought not to be, splashes of varnish), blurred contours,
- Register errors,
- Errors in the text,
- Hot-foil stamping errors (holes in the surface, frayed edges, missing areas),
- Scratches and other mechanical defects in the surface of the sheet (in the unprinted board, in the printed image, in the varnish or in the foil),
- Matrix codes,
- Missing windows or other applications from previous production steps,
- Variations in multiple-up sheets, and
- Inconsistencies between bar codes/Braille letters and the readable table of contents.

Such checks are usually made through the use of line-scan cameras disposed above the plane of sheet travel. In general, the first step in the folding box production process is a printing step, in which sheets are printed across their entire width in a printing press. Each sheet contains multiple blanks of the folding boxes to be produced. The blanks are subsequently cut out in a die cutting machine. The cut blanks are then fed to a folder gluer, which transforms them into finished folding boxes.

Folder gluers for producing folding boxes from folding box blanks are known to include at least the following processing units having a modular construction:

- a feeder which successively separates the blanks to be processed from a stack at a high speed and feeds them individually to a downstream first processing unit,

- an application unit for applying a strip of an adhesive, generally glue, to the folding flaps that are to be glued, and
- a folding unit in which the blank portions that have been provided with glue are bent, i.e. folded, at a 180° angle to create an adhesive bond.

The folding unit is usually followed by a so-called transfer unit in which the boxes can be counted, marked, and discharged if they are defective.

The next unit is usually a pressing unit at an inlet of which a shingled stream of folded blanks is formed, which is then subjected to pressure for a certain period of time to bond the two blanks at the glue line.

The individual processing units include driven conveying elements for transporting the folding box blanks. Such conveying elements may, for instance, be formed of an upper conveying belt and a lower conveying belt disposed on a side of the machine. The lower conveying belt is guided in a roller cheek and the upper conveying belt is guided in a roller track. The conveying belts are disposed to be transversely adjustable and can thus be adapted to the respective size and format of the folding box blanks. The folding boxes are transported between the upper and lower conveying belts with their printed side facing downward. A folder gluer of that type is known from German Published Patent Application DE 10 2004 022 344 A1.

Since the transport device transports the blanks through the individual processing units with their printed side facing downward, the line-scan camera needs to be disposed beneath the plane of transport of the blanks. Since the camera needs to record a picture of the entire printed width of the blanks, the continuous lower conveying elements present an inconvenience. German Published Patent Application DE 10 2005 050 040 A1 discloses a device for inspecting the back side of a sheet resting on a transport belt. The camera is disposed below the plane of sheet transport in a gap of the transport belt. For that purpose, deflection rollers are provided to form a transport belt loop. The disadvantages of that apparatus are that the available installation space for the camera is limited and that the manufacturing costs for the transport device are relatively high.

SUMMARY OF THE INVENTION

It is accordingly an object of the invention to provide an inspection module and a folder gluer or folding-box gluer having an inspection module, which overcome the hereinafore-mentioned disadvantages of the heretofore-known devices of this general type, which offer sufficient space for a line-scan camera and in which errors and defects are reliably identified as blanks are transported through the module.

With the foregoing and other objects in view there is provided, in accordance with the invention, an inspection module for inspecting flat, sheet-shaped material made of paper, board or the like, in particular printed or unprinted sheets, folding box blanks or folding boxes, comprising an inspection system which includes at least a camera, a light source and a housing. A transport device guides the sheet-shaped material past the inspection system. The inspection system is disposed above and/or below the transport device. The transport device has a subdivided construction and is formed of an upper and/or a lower conveying device.

With the objects of the invention in view, there is also provided a particularly preferred embodiment of an inspection module for inspecting flat, sheet-shaped material made of paper, board or the like, in particular printed or unprinted sheets, folding box blanks or folding boxes, from below, comprising an inspection system formed of a camera, a light source, and a housing. The camera, light source and housing are disposed below the plane of box blank transport in a gap formed in the transport device. The transport device for the inspection module includes at least one upper and one lower conveying device which include conveying elements that contact each other. At least one of the upper and/or lower conveying devices is connected to a drive. All of the sheets or blanks to be inspected are guided between the contacting conveying elements. The lower conveying device has a divided construction and is formed of at least two conveying devices with a gap formed between the conveying devices. The inspection system is disposed in the gap between the lower conveying devices. Of course, the upper conveying device may likewise have a divided construction.

In accordance with another advantageous feature of the invention, the light source may be disposed either outside the housing or inside the housing. The light source may, however, also be part of the housing, preferably as the upper part of the housing. A particular advantage of such a configuration is that the light source may be directed very precisely to the camera inspection line without any impediment presented by the housing.

In accordance with a further advantageous feature of the invention, the housing of the camera is connected to a blown air source in order to supply a stream of air to the housing. This air stream may exit the housing at a slit-shaped upper gap. In this case, the upper gap is either formed by the housing itself or by the housing and the light source together. The air stream, which flows through the housing and the slit-shaped gap in an upward direction, causes the sheet-shaped material, for instance a box blank, to be pressed against the upper conveying element, thus contributing to a much smoother transport of the box blank in the region of the camera and consequently allowing high-resolution inspections. In addition, the blown air causes turbulences inside the housing and thus has a cleaning effect on the optical system of the camera and on the box blank and prevents dust and cutting waste from entering due to the positive pressure in the housing. In addition, the blown air has a cooling effect on the light source of the inspection system, thus extending the useful life of the LEDs.

In accordance with an added particularly advantageous feature of the invention, the blown air is fed to the housing by a blower such as a fan, a side channel blower/compressor, or a roller compressor. Producing the blown air through the use of a side channel blower or roller compressor is much more cost-efficient and effective than by compressed air or suction air. In addition, a higher volume flow is generated, thus achieving a better cooling effect. However, in accordance with the invention, an apparatus including suction belts and a suction device as the upper conveying device is conceivable, although it would be more complicated.

In accordance with an additional advantageous feature of the invention, the camera and its housing are supported on two round guides and can thus be adjusted in the transverse direction relative to the direction of transport of the sheets or folding boxes in a known way, for instance using a spindle. Thus, an inspection is easily possible in any location—even in non-central locations—across the direction of transport of the products. Furthermore, without much effort, it is possible to place a number of cameras adjacent each other or behind each other. This makes the inspection device adaptable to different operating widths and different inspections in a simple and cost-efficient way.

In accordance with yet another advantageous feature of the invention, the width of the gap between the two lower conveying devices is variable. This feature can be implemented, for instance, by providing telescopic lower belt conveyors. Thus, the width of the gap is variable and can therefore be adjusted to accommodate cameras and housings of different dimensions.

In accordance with yet a further advantageous feature of the invention, the inspection module is integrated into an existing processing module. This configuration is particularly cost-efficient. Alternatively, the printed image inspection system may be integrated into its own inspection module, which is then installed between two existing processing modules in the machine structure of the folder gluer. Thus, the flexibility of the device in terms of its place of installation is increased.

In accordance with yet an added feature of the invention, the inspection module may also be used as an offline device and may thus be combined with further modules as required for a specific application such as a feeder, a waste discharge device and a delivery. Alternatively, the provision of a sorter instead of a waste discharge device may be expedient if various products are to be sorted.

In accordance with yet an additional feature of the invention, advantageously, the inspection module may be disposed downstream of the feeder or downstream of the alignment module or downstream of a Braille module, depending on the structure of the folder gluer and the inspection requirements for the folding box to be produced. If desired and if the costs of a camera permit in the future, it is conceivable to monitor every processing step through the use of an inspection module.

With the objects of the invention in view, there is additionally provided a folder gluer, comprising a processing module for producing folding boxes, and an inspection module according to the invention being integrated into the processing module.

With the objects of the invention in view, there is furthermore provided a folder gluer, comprising two processing modules, and an inspection module according to the invention being constructed as a separate module of the folder gluer in its own inspection module disposed between the two processing modules.

In accordance with a concomitant feature of the invention, a feeder or an alignment module or a Braille module is disposed upstream of the inspection module.

Other features which are considered as characteristic for the invention are set forth in the appended claims.

Although the invention is illustrated and described herein as embodied in an inspection module and a folder gluer or folding-box gluer having an inspection module, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
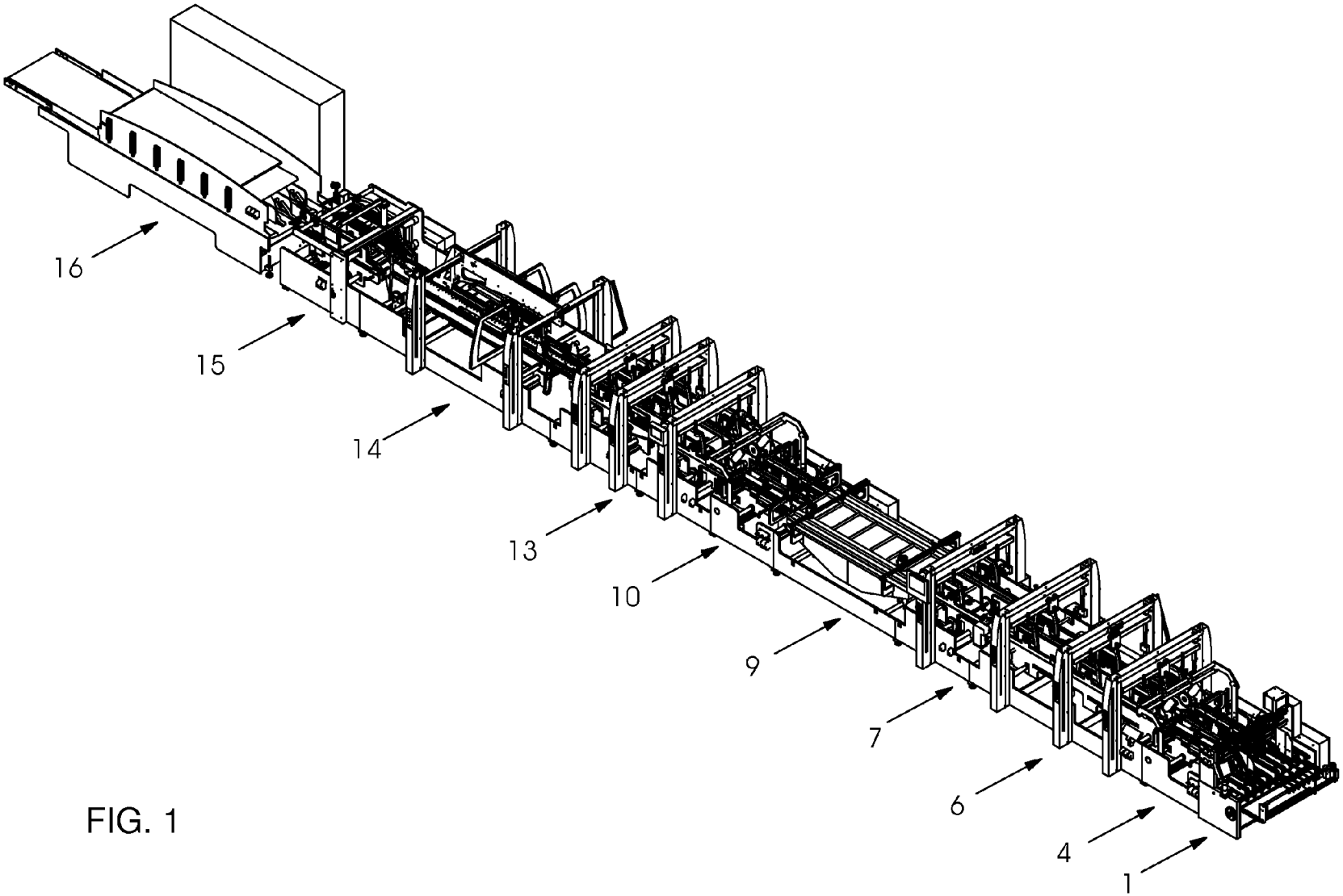
FIG. 1 is a diagrammatic, perspective view of examples of processing units in a folder gluer.

Referring now in detail to the figures of the drawings and first, particularly, to FIG. 1 thereof, there are seen examples of individual processing units in a folder gluer or folding-box gluer in which all exemplary embodiments of the folder gluer include several processing units through which folding box blanks pass in succession.

The folder gluer starts in the lower right-hand corner of FIG. 1. The first unit is a feeder 1 which successively separates individual blanks to be processed from a stack at a high speed to feed them individually to a downstream processing unit. The feeder 1 is followed by an alignment unit 4 in which the blanks are individually aligned against a lateral stop. Transversely positionable machine components in the form of two belt pairs are used as conveying elements to guide the blanks through the alignment device. Actuating drives are provided to move the components in the transverse direction.

The next units are a prefolding unit 6 and a first folding module 7. The blanks are guided through both the prefolding unit 6 and the folding unit 7 by transversely positionable machine components in the form of belt pairs that act as conveying elements. An actuating drive is provided to move the conveying elements in the transverse direction to position them as needed for the specific blank type to be processed.

The folding module 7 is followed by a rotating unit 9. The rotating unit 9 rotates the blanks through a 90° angle about a vertical axis. For this purpose, it includes two parallel conveying sections that are disposed adjacent each other. The speeds of the two conveying sections can be adjusted independently of each other. During transport, the blanks lie flat on the two conveying sections and are thus rotated when the two conveying sections move at different speeds. The two conveying sections include driven rollers as conveying elements.

As the blanks exit the rotating unit 9, they are fed to a further alignment unit 10 which corresponds to the alignment unit provided downstream of the feeder 1 from a structural point of view. Thus, it likewise includes transversely positionable machine components, namely conveying belt pairs, as conveying elements.

A following processing unit 13 is used to carry out processing operations as required for the type of box to be created. For example, further crease lines may be prefolded or special folds may be made. The conveying elements that guide the blanks through the processing unit 13 are likewise belt pairs that can be positioned in the transverse direction through the use of actuating drives.

In a following folding unit 14, blank sections that have been provided with a line of glue are folded at a 180° angle. The folding unit 14 includes belt pairs as conveying elements and a glue application unit. Actuating drives are provided to move the belt pairs into a transverse position as a function of the type of blank to be processed. The folding unit is followed by a transfer unit 15 which ensures that the blanks with their glue lines that have not yet been bonded are in accurate alignment when they are fed to a downstream accumulation and pressure device 16. In the accumulation and pressure device 16, a shingled stream of folded blanks is formed and is then subjected to pressure between conveying pressure belts for a certain amount of time for the glue lines to bond. The transfer unit likewise includes belt pairs that can be adjusted in the transverse direction through the use of actuating drives.

Figure 2:
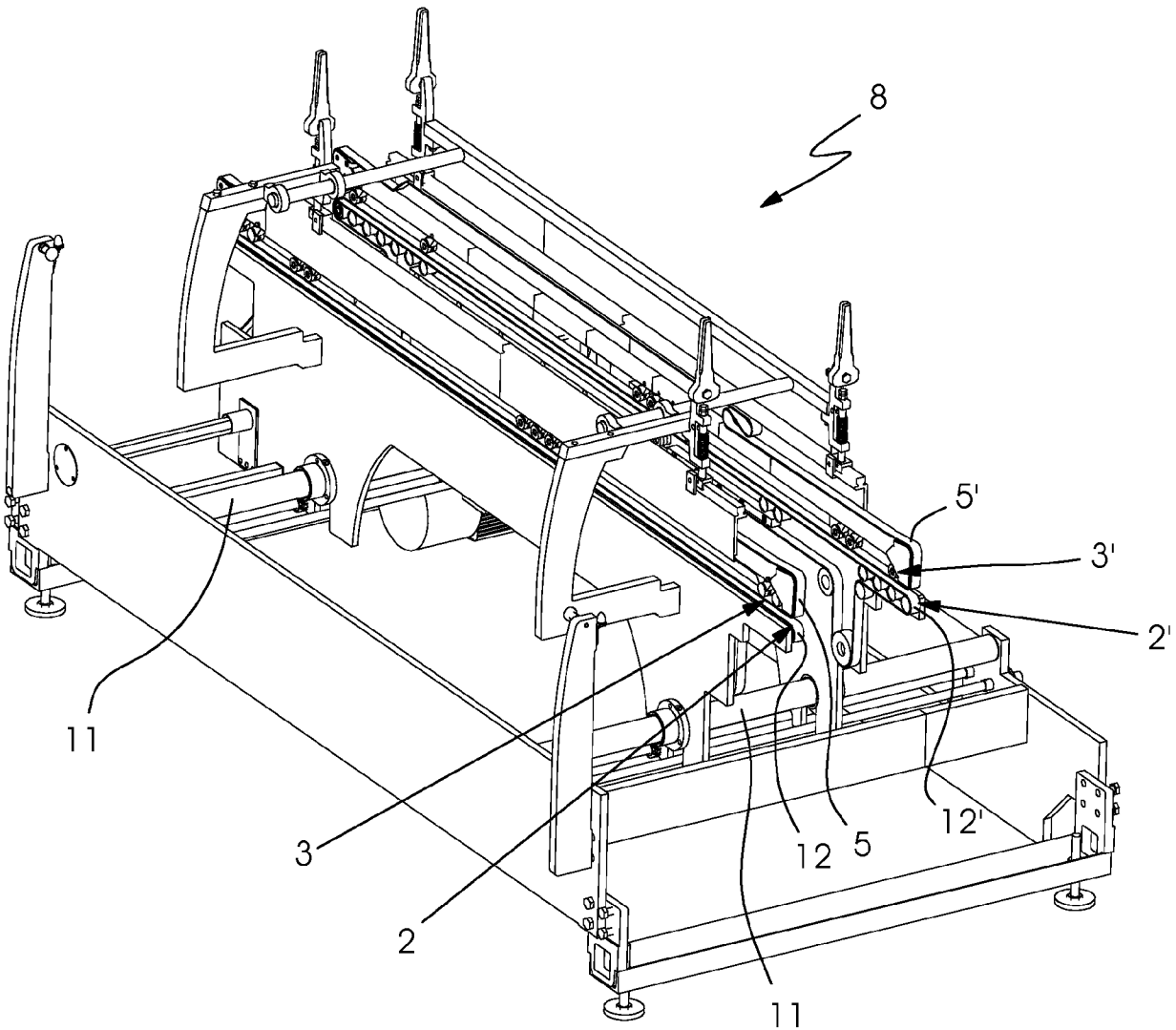
FIG. 2 is a perspective view of a continuous transport device of the prior art in a processing unit of a folder gluer.

FIG. 2 illustrates an example of a transport device 8 including respective upper left-hand and upper right-hand conveying devices 3, 3' and respective lower left-hand and lower right-hand conveying devices 2, 2', and which is constructed in the given example as a belt conveyor including suitable conveying belts as conveying elements 5, 5', 12, 12'. The conveying devices 3, 3', 2, 2' are supported on round crossbars 11 and are thus adjustable to the respective width of the box blanks.

In the following diagrammatic representation, only one upper and one lower conveying device are shown for reasons of clarity.

Figure 3:
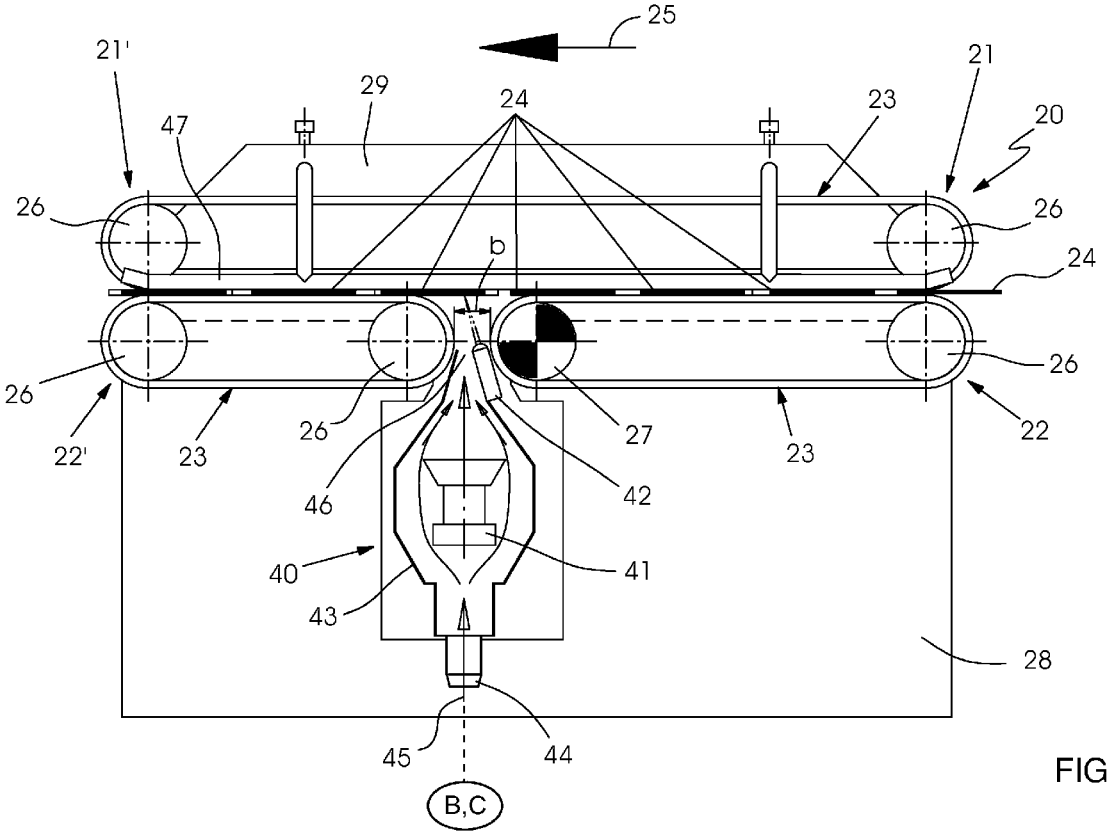
FIG. 3 is a side-elevational view of an inspection module in accordance with the invention.
Figure 4A:
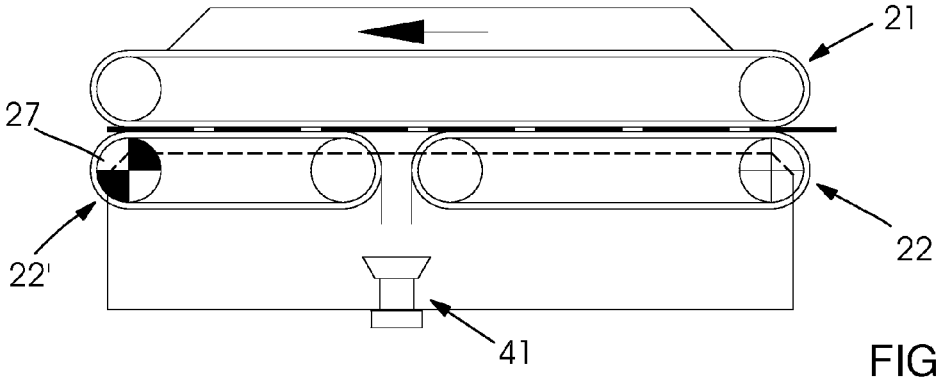
FIGS. 4A-4D are side-elevational views of printed image inspection devices including transport devices embodied as belt conveyors for a camera inspection system within a module.
Figure 4B:
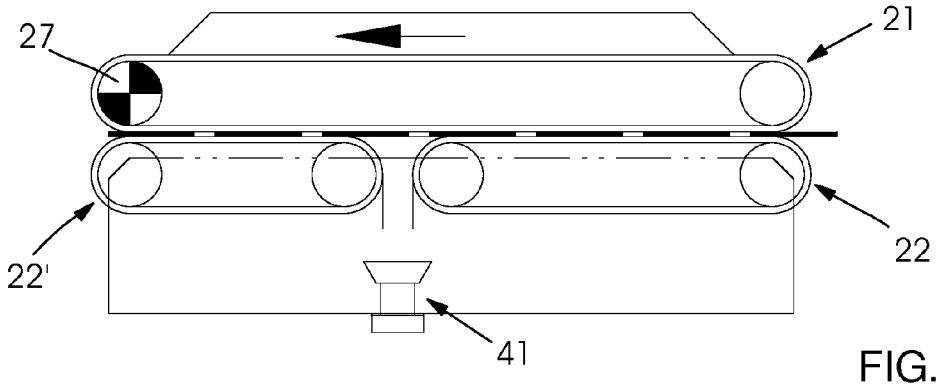
Figure 4C:
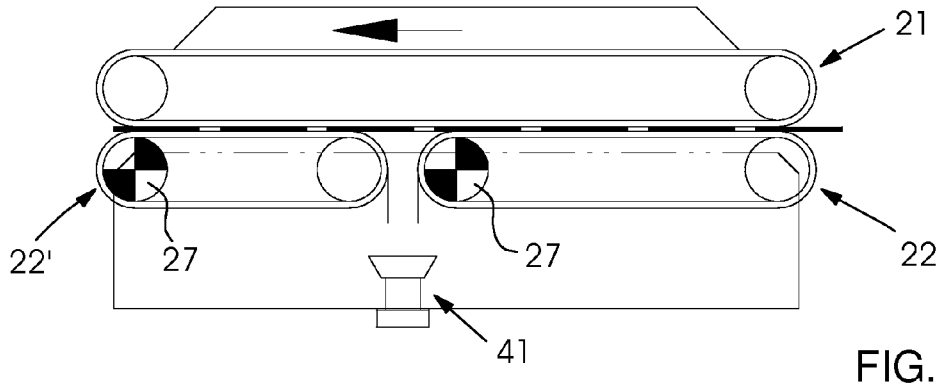
Figure 4D:
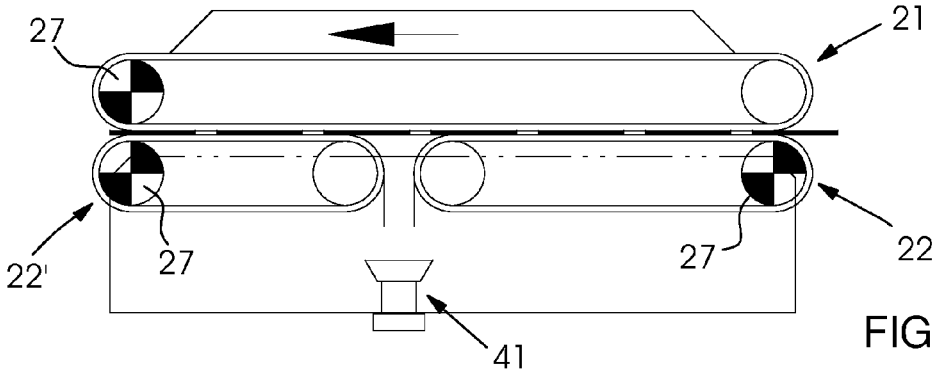
Figure 5A:
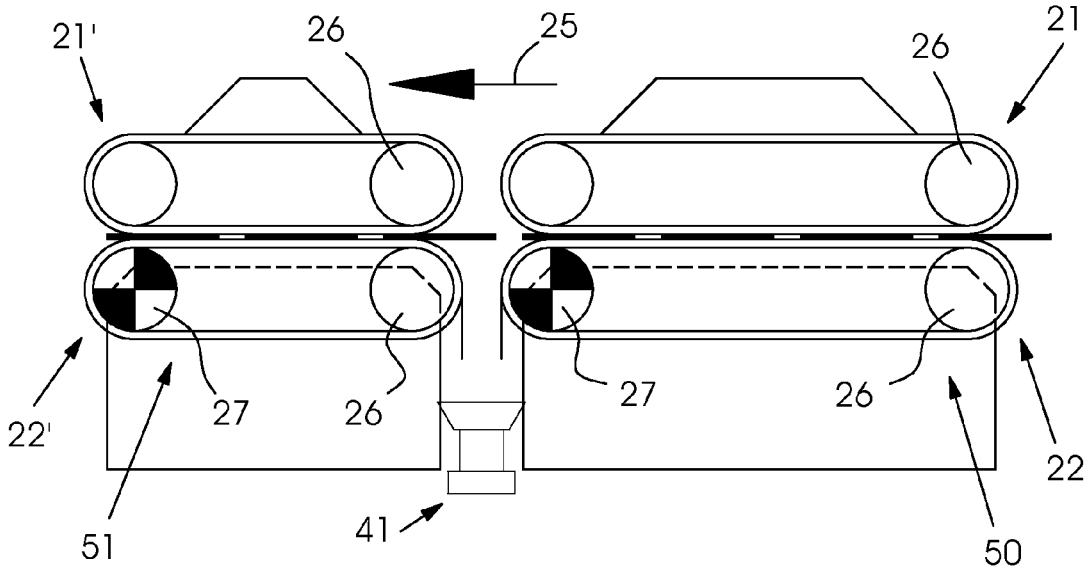
FIGS. 5A-5E are side-elevational views of printed image inspection devices including transport devices embodied as belt conveyors for a camera inspection system disposed between two processing modules.
Figure 5B:
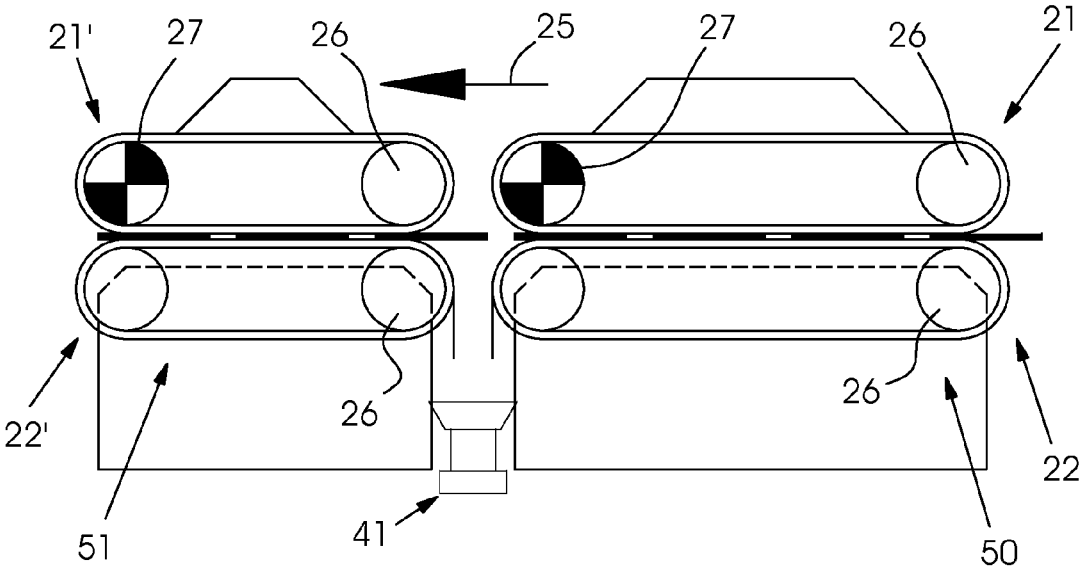
Figure 5C:
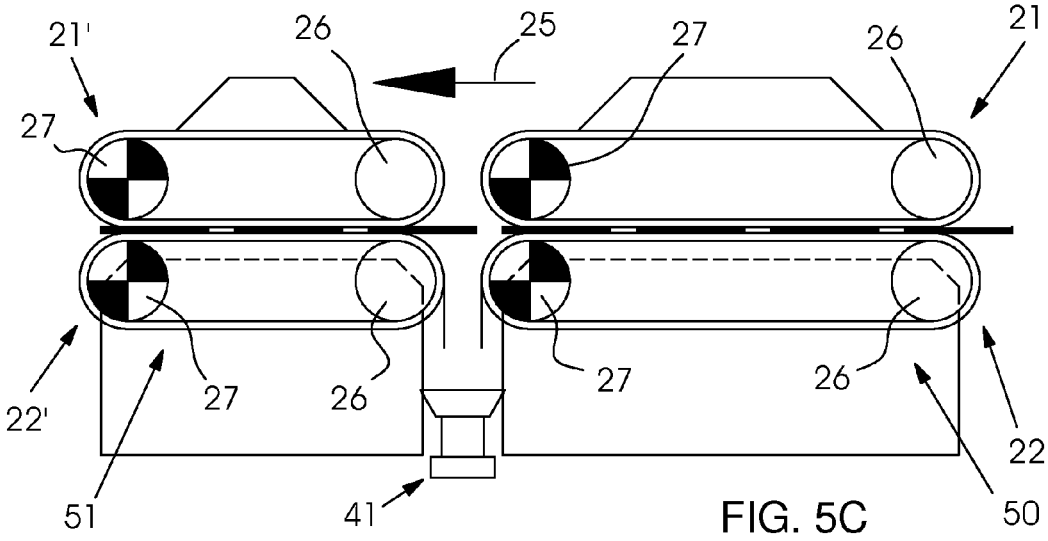
Figure 5D:
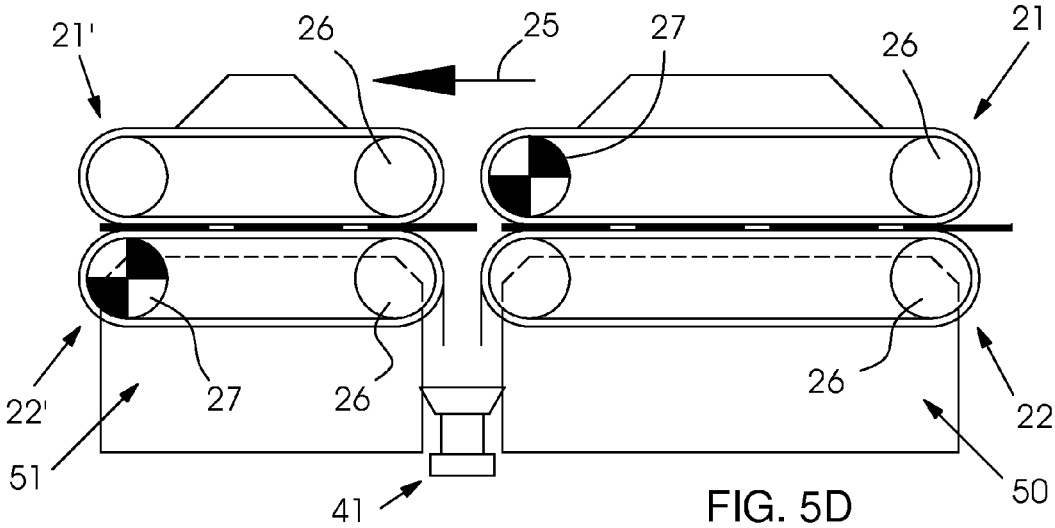
Figure 5E:
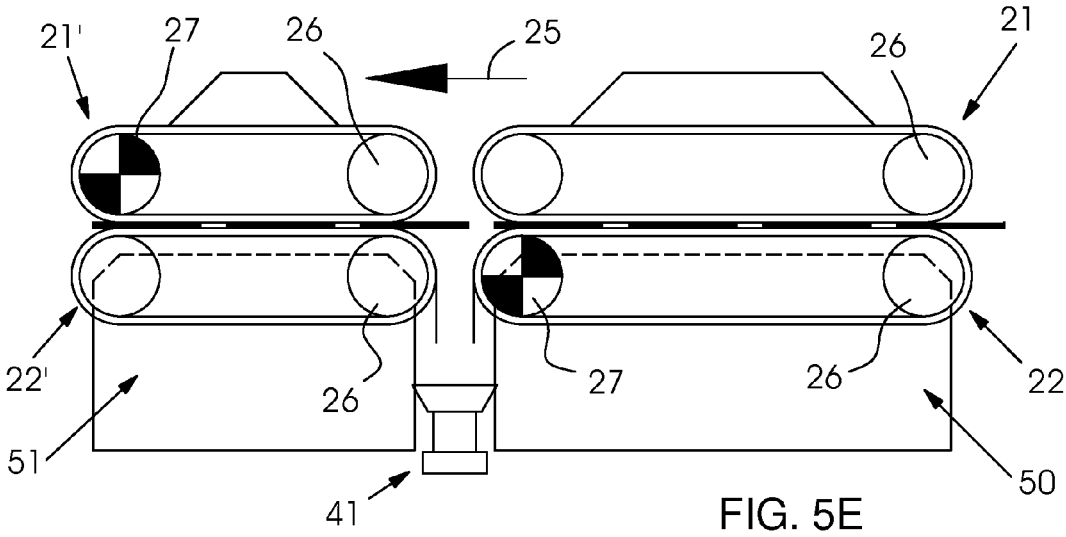

FIG. 3 illustrates an inspection module of the invention. A transport device 20 moves sheet-shaped material 24, such as folding box blanks that are to be inspected, through the inspection module in a conveying direction 25. In the illustrated embodiment, the transport device 20 includes an upper conveying device 21 having an endless conveying element 23, which is guided by deflection rollers 26. The transport device 20 also includes two lower conveying devices 22, 22', which are disposed at a distance b from each other to form a gap. The two lower conveying devices 22, 22' also include conveying elements 23 that are guided by deflection rollers 26. As viewed in the conveying direction 25, the second deflection roller 26 of the first lower conveying device 22 is connected to a drive, as indicated by triangular shading, thus acting as a drive roller 27 for the conveying element 23 of the lower conveying device. In the illustrated exemplary embodiment, the conveying elements 23 are embodied as endless transport belts. The conveying elements 23 of the upper and lower conveying devices 21, 22, 22' contact each other to clamp the sheets 24 to be transported between each other. As is known in the art, the upper conveying device is supported in a roller track 29 and the lower conveying devices are supported in roller cheeks 28.

An inspection system 40 for inspecting the sheets that are transported across the gap from below is disposed below the plane of sheet transport in the gap between the lower conveying devices 22, 22'. The inspection system 40 includes a camera 41, a light source 42 and a housing 43. The light source 42 may be disposed inside or outside the housing 43 or may be part of the housing 43 as in the illustrated example. The housing 43 is connected to a blown air connection 44 for supplying blown air 45 to the interior of the housing 43, for instance from a source such as a blower or a side channel compressor or a roller compressor B, C. The air stream flows around the camera and possibly the light source and exits the housing 43 at a preferably slit-shaped gap 46 formed at the upper end of the housing 43 to impact or hit the sheet-shaped material and press it against the upper conveying element 23, thus contributing to a much smoother transport of the sheet-shaped material in the region of the inspection system. In addition, a hold-down element 47 may optionally be provided above the sheets to further assist in a smooth transport of the sheets.

The inspection system 40 of the invention may, of course, be combined with other transport devices 20 to form an inspection module. Alternative transport devices are shown in the diagrammatic representations of FIGS. 4A to 4D. The difference between the alternatives is in the drive rollers 27. For reasons of clarity, only the camera 41 of the inspection system 40 is shown.

FIGS. 5A to 5E illustrate further alternatives with regard to the transport device 20. In these embodiments, the inspection system 40 of the invention (of which only the camera 41 is shown) is disposed between two processing modules 50, 51. Each of the processing modules 50, 51 includes a respective upper transport device 21, 21' and a respective lower transport device 22, 22'. The differences between the individual embodiments are to be found in the driven deflection rollers 27.

Figure 6:
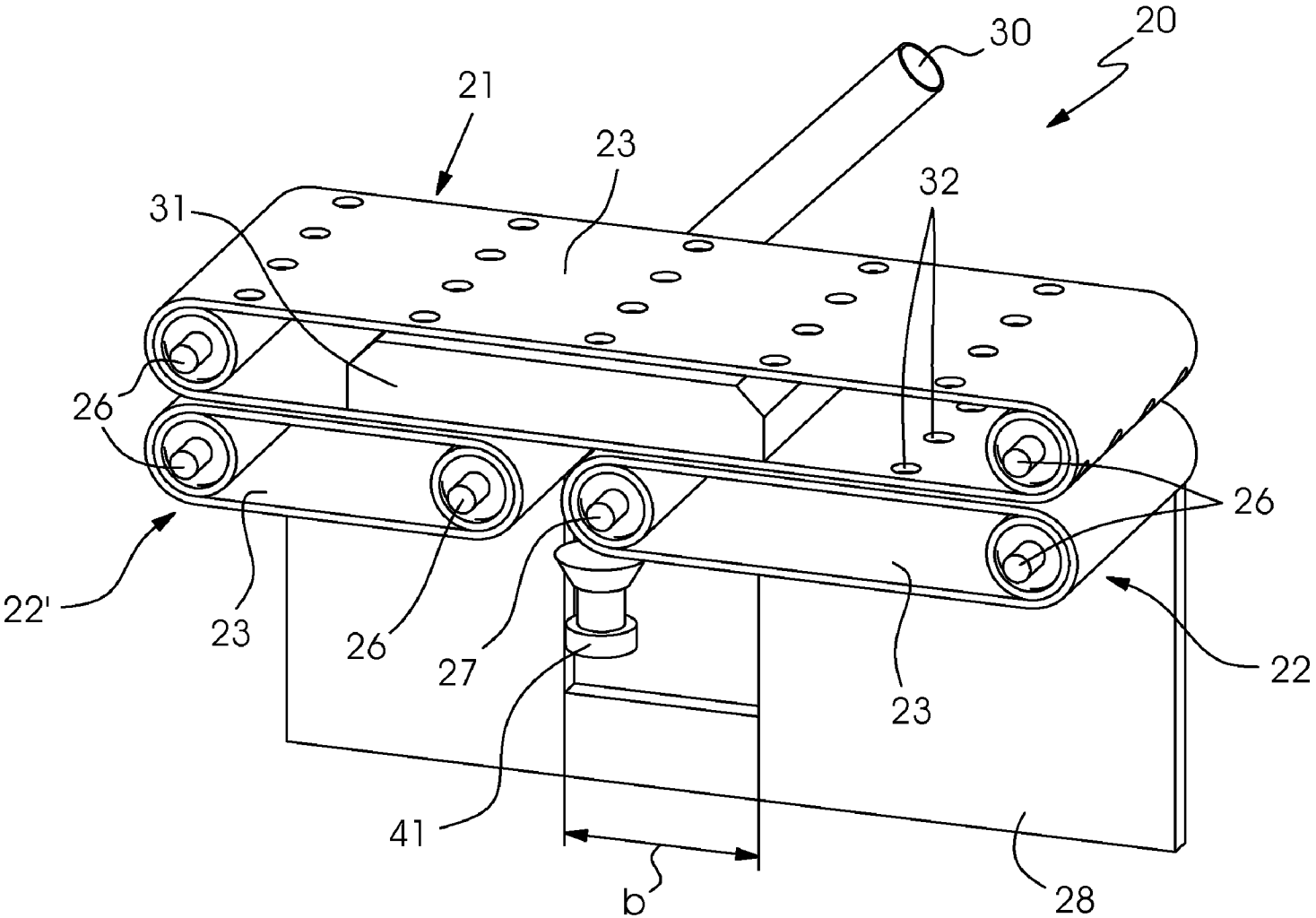
FIG. 6 is a perspective view of an alternative transport device including a suction belt.

FIG. 6 illustrates an alternative embodiment with a transport device 20 in which the conveying element 23 of the upper conveying device 21 is a suction belt. The box blank is held against the suction belt by suction due to holes 32 formed in the suction belt. The holes 32 communicate with a suction box 31 that is connected to a vacuum source 30. As in the embodiments described above, transport is achieved by connecting at least one of the deflection rollers 26 of the upper conveying device 21 or of the two lower conveying devices 22, 22' to a drive. The inspection system 40 (of which only the camera 41 is shown) is disposed below the plane of sheet travel in the gap formed between the lower conveying devices 22, 22'.

Figure 7A:
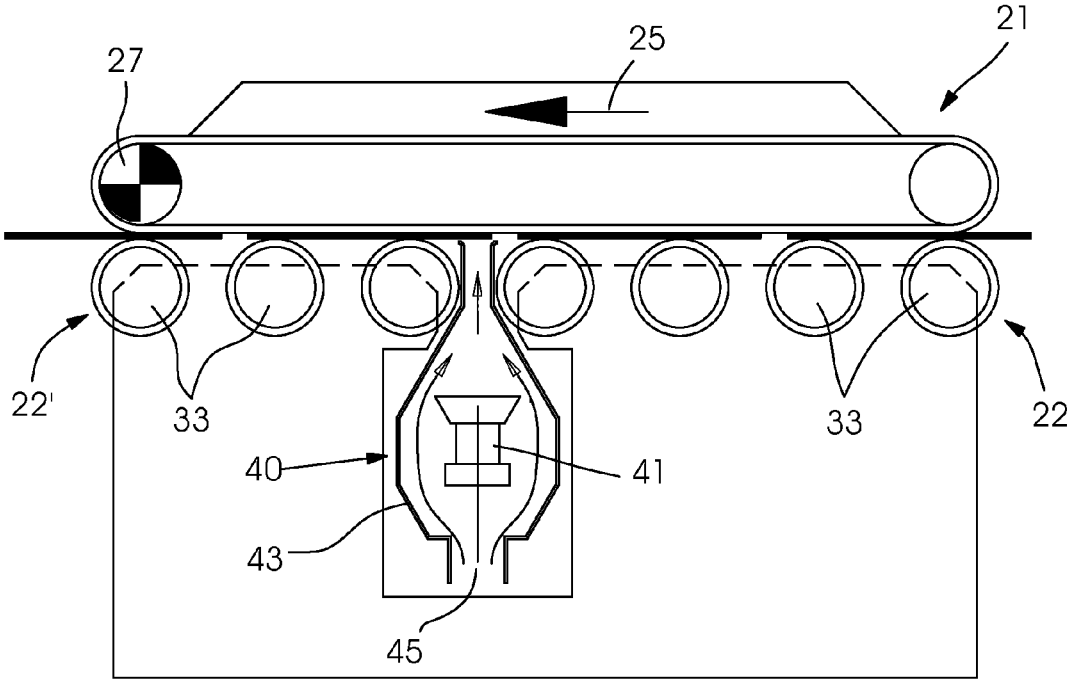
FIGS. 7A and 7B are side-elevational views of alternative transport devices including transport rollers.
Figure 7B:
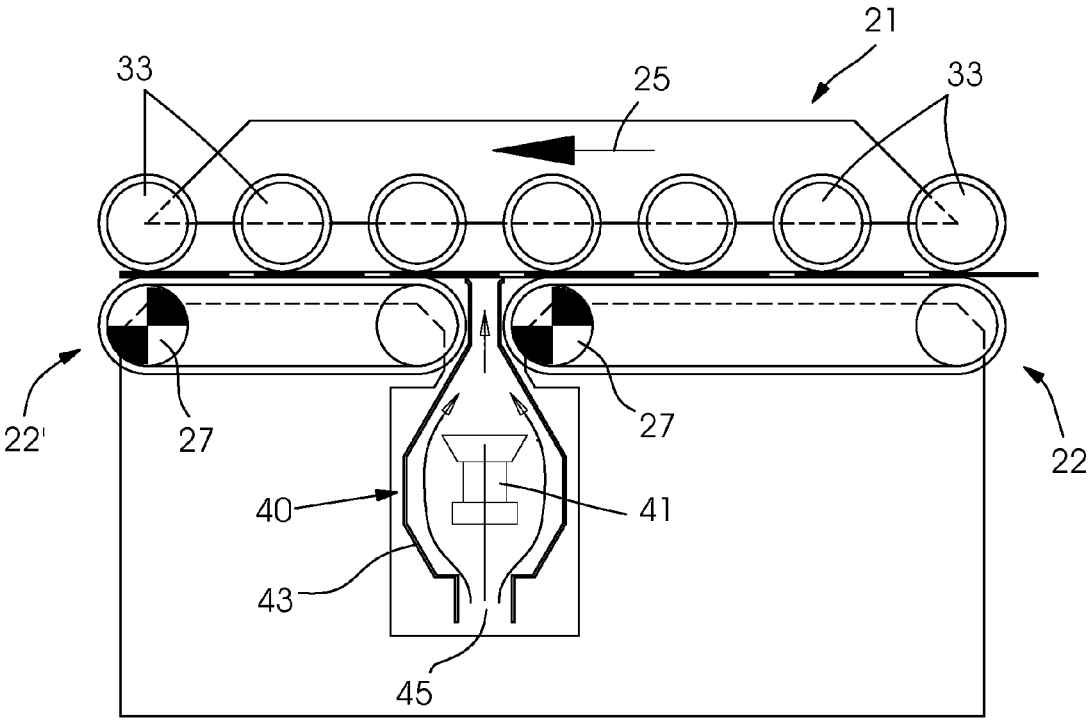

FIGS. 7A and 7B illustrate two further alternative embodiments. In FIG. 7A, the two lower conveying devices 22 and 22' include rollers 33 as the conveying elements and the upper conveying device 21 is a belt conveyor with the second deflection roller 26, as viewed in the conveying direction, as the driven deflection roller 27. In FIG. 7B, the reverse is the case. The upper conveying device 21 includes rollers 33 as the conveying elements and the lower conveying devices 22, 22' are respectively embodied as driven belt conveyors.

Figure 8:
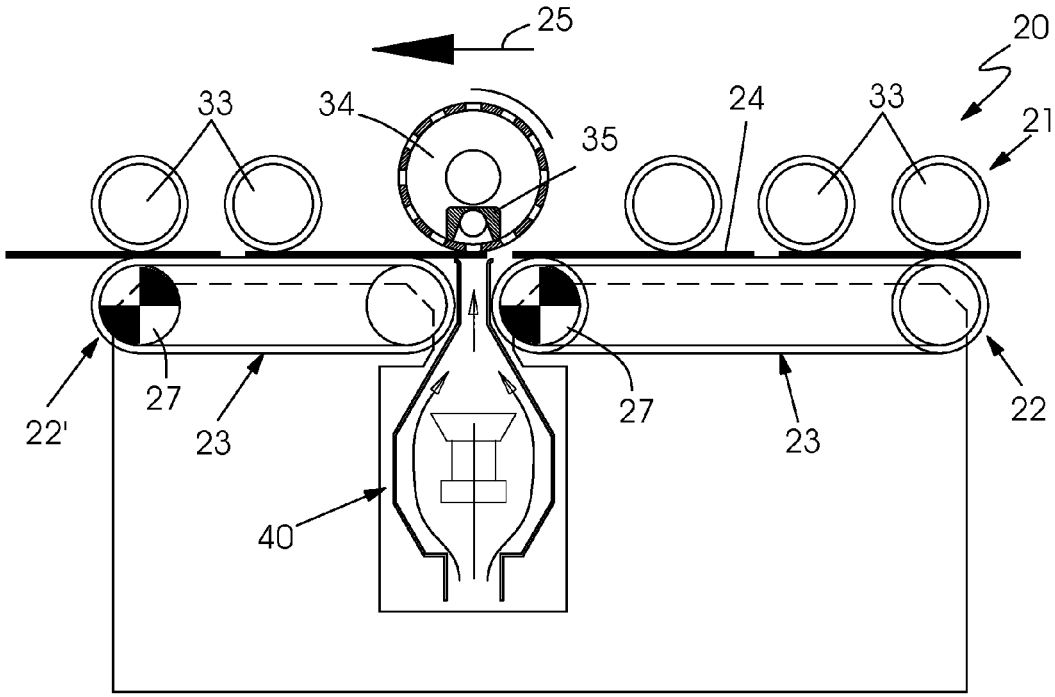
FIG. 8 is a side-elevational view of an alternative transport device including a suction roller.

FIG. 8 illustrates another alternative embodiment. In this embodiment, the transport device 20 includes two driven lower conveying devices 22, 22'. The upper conveying device 21 is formed of rollers 33 and a suction roller 34 with a stationary suction head 35. The rotating suction roller 34 is located above a gap formed between the two lower conveying devices 22, 22' that are disposed at a gap width or distance b apart from each other. The suction head 35 for attracting the folding box blanks 24 by suction is disposed in a hollow chamber of the suction roller 34. A suction region inside the roller is limited in a lower region, thus allowing the blank to be released as it leaves the gap.

Figure 9:
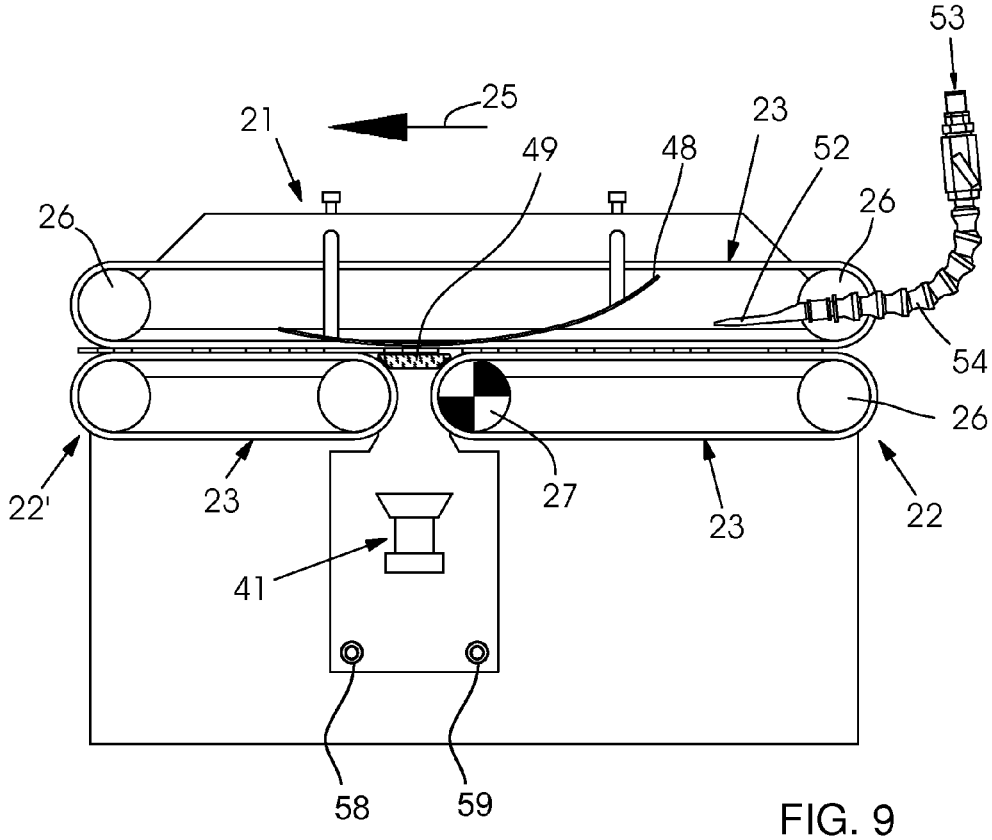
FIG. 9 is a side-elevational view of an alternative inspection module.

A further alternative embodiment is shown in FIG. 9. In this embodiment, there is no blown air from below to aid in the transporting of the sheets. The camera 41 is still disposed below the plane of sheet transport in a gap formed between the lower conveying devices 22, 22' and is adjustable on round guides 58, 59. The gap underneath the sheets is covered by a glass plate 49 so that an inspection from below through the use of the camera continues to be possible. A guide plate 48 is disposed above the sheets to be transported. In addition, a compressed air hose 54 with a connection 53 to a vacuum source is provided above the sheets. A nozzle 52 provided at the end of the compressed air hose 54 suctions air between the guide plate 48 and the sheets 24, thus creating a negative pressure on the surface of the guide plate 48 to draw the sheets to be transported against the guide plate by suction.

Figure 10B:
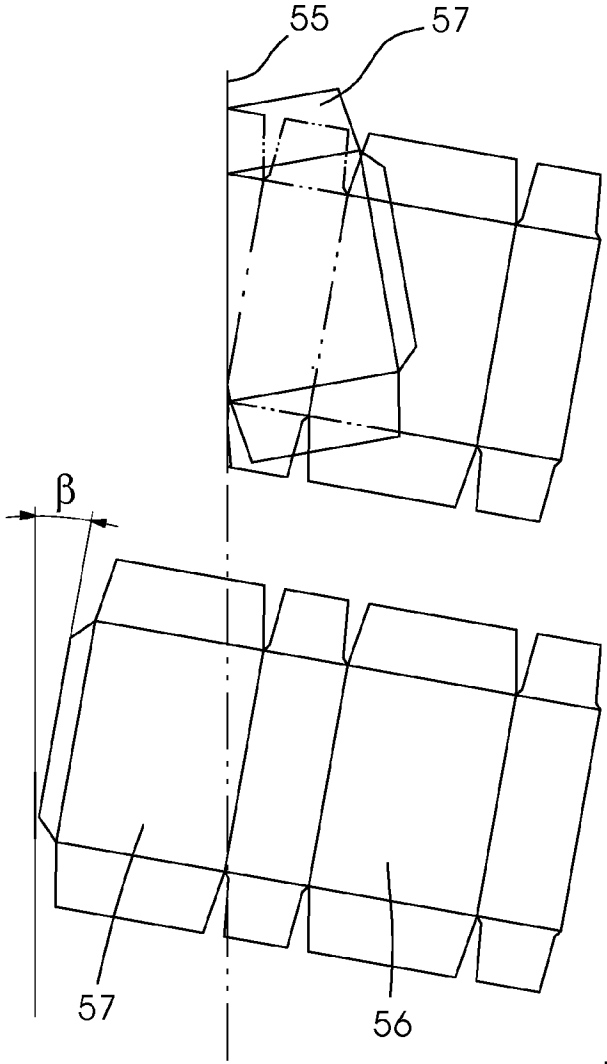
FIGS. 10A and 10B are plan views of box blanks illustrating a possible alternative application of the inspection module.
Figure 10A:
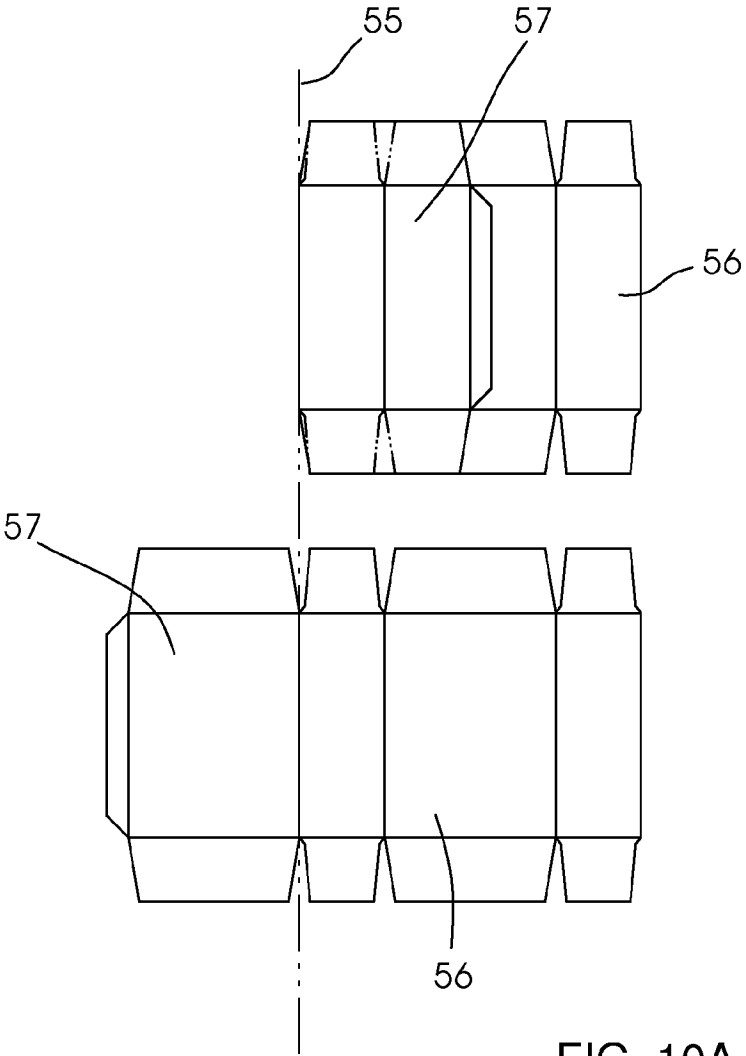

FIGS. 10A and 10B illustrate a further possible application of the inspection module. In addition to checking for defects in the paper or printed image, the camera can also be used to inspect the quality of the alignment of the alignment module 4. The quality of the alignment is crucial for subsequent production steps and for the quality of the folds of the finished folding box.

As can be seen in FIG. 10A, a box blank 56 with its crease line 55 is to be fed to the folding unit as accurately as possible to allow a box blank section 57 to be folded parallel to the other outer edge. As is shown in FIG. 10B, any greater rotation in a clockwise or counterclockwise direction would result in non-parallel edges of the folding boxes.

The quality of the alignment can be monitored through the use of the inspection system of the invention. During operation, an angle of deviation β is determined based on the picture taken by the camera 41. Then the blank 56 is rotated until the recorded image is congruent with a stored reference image. This correction is made until a stored maximum angle of deviation $\beta_{max}$ of up to 2°, for instance, is achieved. If the angle of deviation β is greater than the stored maximum angle of deviation $\beta_{max}$, the inspection system generates an error message and the box is discharged.

Alternatively, an error message may be displayed to the machine operator in order for him or her to make suitable adjustments to the alignment module 4 of the folder gluer.

The invention claimed is:

1. An inspection module for inspecting sheet-shaped material in the form of flat, printed or unprinted sheets, folding box blanks or folding boxes made of paper or board, the inspection module comprising:

an inspection system including a camera, a light source and a housing disposed below a sheet transport plane;

a sheet transport device for transporting the sheet-shaped material in a transport direction, said transport device having a divided construction in said transport direction and including at least one upper and at least one lower conveying device with conveying elements contacting each other; and a drive connected to at least one of said upper or lower conveying devices;

the inspection module being part of a folder gluer.

2. The inspection module according to claim 1, wherein said light source is part of said housing.

3. The inspection module according to claim 1, wherein said light source is disposed inside said housing.

4. The inspection module according to claim 1, wherein said light source is disposed outside said housing.

5. The inspection module according to claim 1, which further comprises a blown air connection connected to said housing for supplying a stream of air entering inside said housing and exiting from an upper gap of said housing.

6. The inspection module according to claim 5, wherein said upper gap of said housing is slit-shaped.

7. The inspection module according to claim 5, which further comprises a blower or a side channel compressor or a roller compressor feeding the blown air to said housing.

8. The inspection module according to claim 1, wherein said camera is supported for adjustment in a direction transverse to said transport direction.

9. The inspection module according to claim 1, wherein said inspection system includes several cameras disposed at least one of adjacent or behind each other.

10. The inspection module according to claim 1, wherein said two lower conveying devices define a gap therebetween having a variable width.

11. The inspection module according to claim 1, wherein the inspection module is constructed as an offline device.

12. A folder gluer, comprising:

a processing module for producing folding boxes; and an inspection module according to claim 1 being integrated into said processing module.

13. The folder gluer according to claim 12, which further comprises a feeder or an alignment module or a Braille module disposed upstream of said inspection module.

14. A folder gluer, comprising:

two processing modules; and an inspection module according to claim 1 being constructed as a separate module of the folder gluer in its own inspection module disposed between said two processing modules.

15. The folder gluer according to claim 14, which further comprises a feeder or an alignment module or a Braille module disposed upstream of said inspection module.

16. An inspection module for inspecting sheet-shaped material in the form of flat, printed or unprinted sheets, folding box blanks or folding boxes made of paper or board, the inspection module comprising:

a sheet transport device including at least one upper and at least one lower conveying device with conveying elements contacting each other for transporting the sheet-shaped material;

said lower conveying device having a divided construction with at least two conveying devices defining a gap therebetween;

an inspection system including a camera, a light source and a housing disposed below a sheet transport plane in said gap; and a drive connected to at least one of said upper or lower conveying devices;

the inspection module being part of a folder gluer.

17. The inspection module according to claim 16, wherein said light source is part of said housing.

18. The inspection module according to claim 16, wherein said light source is disposed inside said housing.

19. The inspection module according to claim 16, wherein said light source is disposed outside said housing.

20. The inspection module according to claim 16, which further comprises a blown air connection connected to said housing for supplying a stream of air entering inside said housing and exiting from an upper gap of said housing.

21. The inspection module according to claim 20, wherein said upper gap of said housing is slit-shaped.

22. The inspection module according to claim 20, which further comprises a blower or a side channel compressor or a roller compressor feeding the blown air to said housing.

23. The inspection module according to claim 16, wherein said camera is supported for adjustment in a direction transverse to a transport direction for the sheet-shaped material.

24. The inspection module according to claim 16, wherein said inspection system includes several cameras disposed at least one of adjacent or behind each other.

25. The inspection module according to claim 16, wherein said gap between said two lower conveying devices has a variable width.

26. The inspection module according to claim 16, wherein the inspection module is constructed as an offline device.

27. A folder gluer, comprising:

a processing module for producing folding boxes; and an inspection module according to claim 16 being integrated into said processing module.

28. The folder gluer according to claim 27, which further comprises a feeder or an alignment module or a Braille module disposed upstream of said inspection module.

29. A folder gluer, comprising:

two processing modules; and an inspection module according to claim 16 being constructed as a separate module of the folder gluer in its own inspection module disposed between said two processing modules.

30. The folder gluer according to claim 29, which further comprises a feeder or an alignment module or a Braille module disposed upstream of said inspection module.

* * * * *